US010174701B2

(12) United States Patent
Denk et al.

(10) Patent No.: US 10,174,701 B2
(45) Date of Patent: Jan. 8, 2019

(54) METHOD AND DEVICE FOR DETECTING THE COMMENCEMENT OF OPENING OF A NOZZLE NEEDLE

(71) Applicant: Continental Automotive GmbH, Hannover (DE)

(72) Inventors: Frank Denk, Obertraubling (DE); Nikolay Belyaev, Regensburg (DE); Christian Hauser, Lappersdorf (DE); Anatoliy Lyubar, Wolfsegg (DE); Gerd Roesel, Regensburg (DE); Markus Stutika, Regensburg (DE)

(73) Assignee: Continental Automotive GmbH, München (DE)

( * ) Notice: Subject to any disclaimer, the term of this patent is extended or adjusted under 35 U.S.C. 154(b) by 0 days.

(21) Appl. No.: 15/129,291

(22) PCT Filed: Mar. 5, 2015

(86) PCT No.: PCT/EP2015/054637
§ 371 (c)(1),
(2) Date: Sep. 26, 2016

(87) PCT Pub. No.: WO2015/150015
PCT Pub. Date: Oct. 8, 2015

(65) Prior Publication Data

US 2017/0114746 A1 Apr. 27, 2017

(30) Foreign Application Priority Data

Apr. 3, 2014 (DE) ..... 10 2014 206 430

(51) Int. Cl.
*F02D 41/24* (2006.01)
*F02D 41/20* (2006.01)

(52) U.S. Cl.
CPC ..... *F02D 41/2467* (2013.01); *F02D 41/20* (2013.01); *F02D 2041/2034* (2013.01);
(Continued)

(58) Field of Classification Search
CPC ..... F02D 41/2467; F02D 41/20; F02D 2041/2058; F02D 2041/2055; F02D 2041/2034
See application file for complete search history.

(56) References Cited

U.S. PATENT DOCUMENTS 4,663,576 A * 5/1987 Scarola ..... G05B 19/40 318/685
5,492,009 A * 2/1996 Kempf ..... G01R 31/346 137/551

(Continued)

FOREIGN PATENT DOCUMENTS

DE 102007019099 A1 10/2008
DE 102008041528 A1 3/2010

(Continued)

OTHER PUBLICATIONS

International Search Report and Written Opinion dated Jul. 10, 2015 from corresponding International Patent Application No. PCT/EP2015/054637.

(Continued)

*Primary Examiner* — Joseph Dallo

(57) ABSTRACT

A method for detecting the commencement of opening of the nozzle needle of an injector of an injection system. In the detection method, the coil of the solenoid injector has a voltage applied to it which is so low that the armature is moved toward the nozzle needle at such a low speed that the abutment causes a stoppage of the armature movement, without the nozzle needle being opened. In this case, the idle travel is overcome, but no injection process is initiated. The abutment of the armature against the nozzle needle is (Continued)

detected, in the current profile, as the commencement of opening of the nozzle needle.

8 Claims, 2 Drawing Sheets

(52) U.S. Cl.
CPC ..... *F02D 2041/2055* (2013.01); *F02D 2041/2058* (2013.01)

(56) References Cited

U.S. PATENT DOCUMENTS 6,276,337 B1 * 8/2001 Minato ..... F02D 41/20 123/456
6,724,606 B2 * 4/2004 Seale ..... F01L 9/04 361/152
8,128,004 B2 * 3/2012 Koch ..... G05B 13/021 239/5
2003/0169552 A1 * 9/2003 Seale ..... F01L 9/04 361/160
2010/0224809 A1 * 9/2010 Koch ..... G05B 13/021 251/129.15
2012/0101707 A1 * 4/2012 Kemmer ..... F02D 41/20 701/103
2014/0012458 A1 1/2014 Park
2014/0060488 A1 * 3/2014 Katzenberger ..... F02D 41/2096 123/456
2014/0092516 A1 4/2014 Koch et al.
2015/0108238 A1 * 4/2015 Grandi ..... F02D 41/221 239/5

FOREIGN PATENT DOCUMENTS

DE 102011005285 A1 9/2012
DE 102011086151 A1 5/2013
DE 102012205573 A1 10/2013
DE 102012217121 A1 3/2014
EP 2662555 A1 11/2013
KR 1020130119934 1/2013
KR 1020140031867 3/2014

OTHER PUBLICATIONS

Korean Notice of Allowance dated Nov. 30, 2017 for counterpart Korean patent application No. 10-2016-9030771.

* cited by examiner

METHOD AND DEVICE FOR DETECTING THE COMMENCEMENT OF OPENING OF A NOZZLE NEEDLE

CROSS-REFERENCE TO RELATED APPLICATIONS

This application is a national phase application of PCT/EP2015/054637, filed Mar. 5, 2015, which claims priority to German Application No. 10 2014 206 430.9 filed Apr. 3, 2014. The disclosures of the above applications are incorporated herein by reference.

FIELD OF THE INVENTION

The invention relates generally to a method for detecting the commencement of the opening of the nozzle needle of an injector of an injection system, with which an armature is displaced by applying a voltage to a coil, where the armature overcomes an idle movement and buts up against the nozzle needle.

BACKGROUND OF THE INVENTION

The detection of the commencement of the opening of the nozzle needle or of the point in time of the abutment of the armature on the nozzle needle is based on several principles. The eddy-current driven coupling between the mechanics (armature and injector needle) and the magnetic circuit (coil) generates a feedback signal based on the displacement of the mechanics. A speed-dependent eddy current is induced in the armature as a result of the displacement of the nozzle needle and of the armature, which also causes a reaction on the electromagnetic circuit. Depending on the speed of displacement, a voltage is induced in the electromagnet that is superimposed on the activation signal. The utilization of said effect requires the superimposition of the basic electrical variables voltage or current with the signal change owing to the armature and/or the needle displacement to be suitably separated and then to be further processed. In doing so, the characteristic signal shape in the voltage or current signal is analyzed in relation to the point in time of occurrence.

The following methods for detecting a characteristic signal profile during the opening process are known:

Current Measurement Method

This method requires active influencing of the current profile (the standard activation form) in order to ensure that the magnetic circuit is not saturated. With said measurement techniques, a needle stop measurement signal can only be detected in the event of full drive.

Voltage Measurement

This type of measurement is not possible with the standard activation form because voltage imposition overwrites all characteristics. In doing so it is assumed therefrom that the electromagnetic circuit is controlled with sample-and-hold activation with a boost phase.

If the injector is activated with the standard voltage profile, the nozzle needle is opened very rapidly. No signal is generated in this case because the nozzle needle abutment takes place at a point in time at which the magnet circuit is saturated. There is therefore no signal available for detecting the commencement of the opening of the nozzle needle.

The nozzle needle abutment can only be detected if an activation profile is used with which the nozzle needle abutment takes place when the magnetic circuit is not in saturation. This can be achieved by reducing the needle opening rate, wherein however operation with such a detection profile cannot be carried out permanently because the reduced nozzle needle speed can result in a lower injection quality (atomization, emissions etc.). With such a procedure, the quality of the injection would therefore have been affected.

These and other previously known methods for generally determining the opening or closing time of an electromagnetically driven device use either a measurement channel for the determination of injector opening and closing (current/voltage measurement), with intervention into the energization during the detection of opening, or current measurement alone for detection of the opening and closing times. The intrusive intervention into the basic activation of the coil and the limitations associated therewith, result in altered injection behavior.

SUMMARY OF THE INVENTION

The present invention is a device for detecting the commencement of the opening of the nozzle needle of an injector of an injection system.

The detection method described here concerns a solenoid injector with idle movement between the armature and the nozzle needle. When applying a voltage to the associated coil, the armature is displaced by electromagnetic forces. The nozzle needle is also displaced by a mechanical coupling after overcoming an idle movement and exposes injection holes for fuel delivery. To close the injector, the magnetic force is removed and the nozzle needle is displaced into the closed position by a spring force.

With an injector of such a type, the armature must therefore often overcome an idle movement before it buts up against the nozzle needle and displaces the needle. The abutment of the armature on the nozzle needle can be referred to here as the commencement of the opening of the nozzle needle of the injector.

It is of great importance during this to detect the exact commencement of the opening of the nozzle needle. That is, the manufacture of said injectors is subject to tolerances. Thus, owing to various spring forces, guide play (friction), seat diameter etc., different forces occur during opening and closing of the injector that in turn result in different delay times and thereby different injection amounts.

One object of the invention is to provide a method of the aforementioned type that is simple to implement and that does not have an adverse effect on injection.

This object is achieved according to the invention by a method of the specified type by applying such a low voltage to the coil that the armature is displaced at such a low speed against the nozzle needle that the armature displacement is stopped by the abutment without opening the nozzle needle, and that the abutment of the armature on the nozzle needle is detected in the current profile as the commencement of the opening of the nozzle needle.

With the method according to the invention, the abutment of the armature on the nozzle needle is thus detected as the commencement of the opening of the nozzle needle after overcoming the idle movement without opening the injector. For this purpose, the coil is deliberately subjected to a low voltage that results in a low speed armature displacement. The armature comes into contact with the nozzle needle with such a small impulse that as a result the nozzle needle is not displaced and the armature displacement is stopped. The nozzle needle is therefore not opened, so that no injection process takes place. Therefore, in this way no injection process is affected by the detection of the commencement of the opening of the nozzle needle.

As previously mentioned, the abutment of the armature on the nozzle needle is noticeable in the current profile and can be detected therefrom. The detection of the idle movement corresponding to the commencement of the opening or the abutment of the nozzle needle thus takes place without an injection, so that the previously mentioned disadvantages of low quality injection do not occur.

As mentioned, according to the invention the abutment of the armature on the nozzle needle is detected in the current profile. Here, the procedure is preferably that the first derivative of the current against time is formed and the minimum thereof is associated with the abutment of the armature on the nozzle needle. Said minimum of the first derivative of the current can be positively associated with the armature contact, so that the commencement of the opening of the nozzle needle can be detected without problems.

As tests have shown, good results in relation to the detection are achieved if for example a voltage of 7 V is applied to the coil. The idle movement is thereby overcome and the armature contacts the nozzle needle. A further displacement does not occur with opening of the injector (performing an injection).

The invention further concerns a device for carrying out the previously described method. Said device can be integrated within the control unit of a motor vehicle.

The method according to the invention can thus be carried out completely independently of an actual injection process. The commencement of the opening of the nozzle needle that is detected by the method can therefore be used as an additional parameter for the control of the injection process.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

With a conventional solenoid injector with idle movement between the armature and the nozzle needle, the solenoid coil has been subjected once to a voltage of 7 V and once to a voltage of 14 V. In both cases, a displacement of the armature took place until abutment on the nozzle needle of the injector occurred. In both cases therefore, the idle movement was overcome. For the voltage of 7 V, however, no further displacement took place after the abutment and consequently no opening process of the nozzle needle occurred, so that no injection process occurred. By contrast, when the voltage of 14 V was applied, the armature moved further together with the nozzle needle after abutment on the nozzle needle, so that the nozzle needle was opened and an injection process took place.

Figure 1:
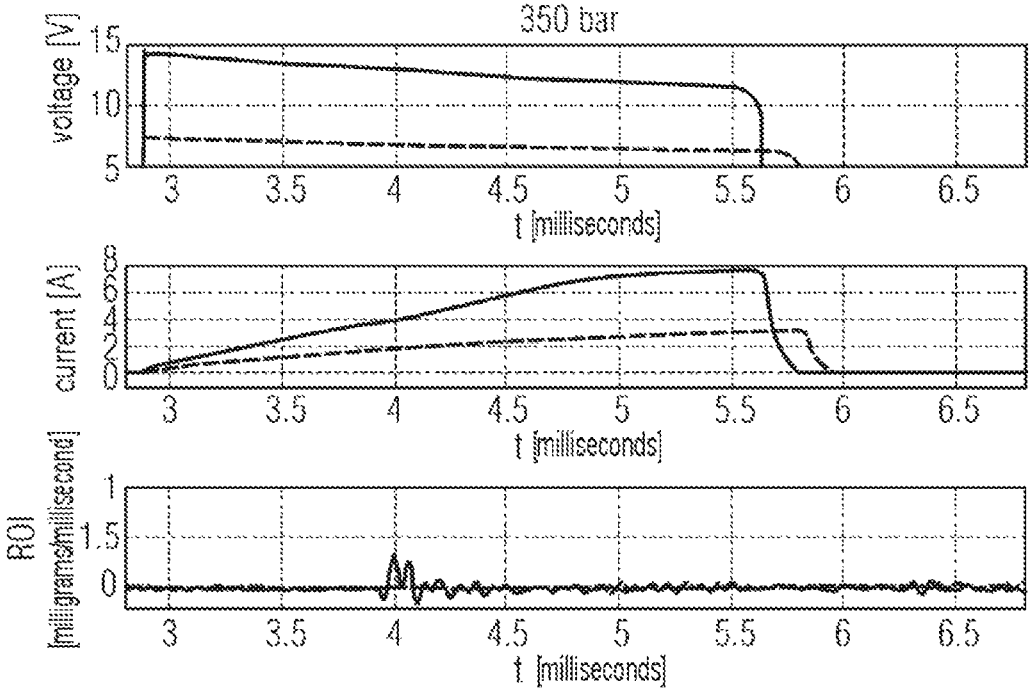
FIG. 1 includes three diagrams in relation to the voltage, current and injection rate profiles for an applied coil voltage of 7 V and 14 V.

FIG. 1 shows in the upper diagram the respective voltage profile, wherein the upper curve shows the profile for 14 V and the lower curve shows the profile for 7 V. The current profile for said voltages is shown in the middle diagram. The upper curve corresponds to the current profile for 14 V, whereas the lower curve reproduces the current profile for 7 V. Finally, the lower diagram shows the injection rate profile ROI. When the voltage of 14 V is applied, after about 4 ms an injection process takes place, whereas for 7 V no injection process can be detected.

Figure 2:
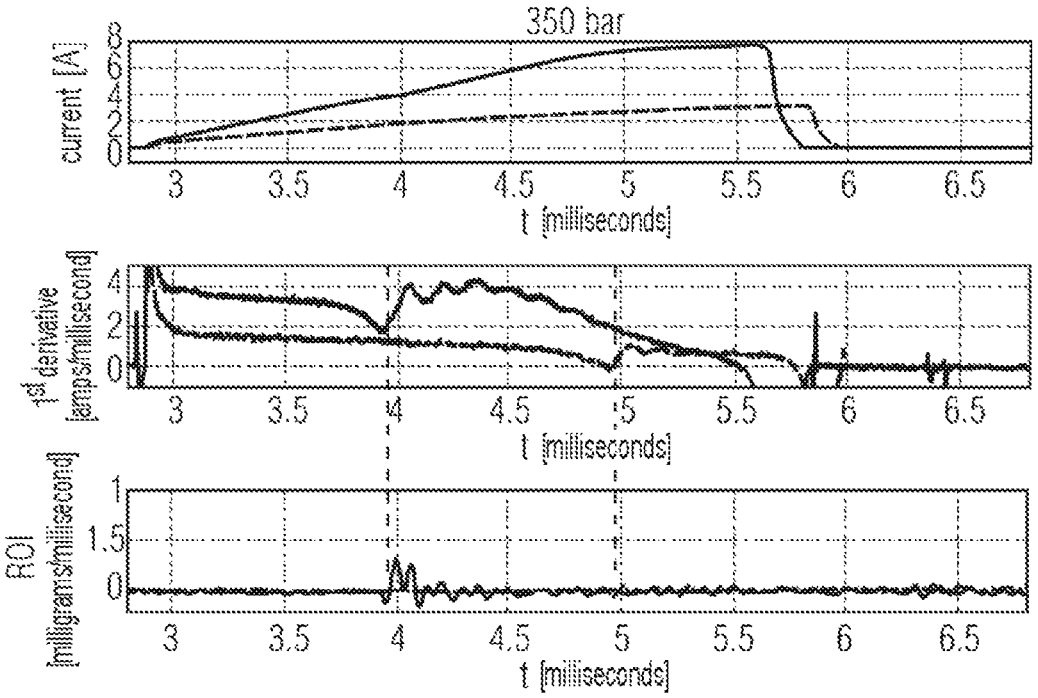
FIG. 2 includes three diagrams in relation to the current profile, the first derivative of the current and the injection rate profile for an applied coil voltage of 7 V and 14 V.

The current profile against time is again shown in FIG. 2 in the upper diagram. Said diagram therefore corresponds to the middle diagram of FIG. 1. The first derivative of the current against time is shown for both voltages of 7 V and 14 V in the middle diagram of FIG. 2. In this case, the upper curve corresponds to the voltage of 14 V, whereas the lower curve corresponds to the voltage of 7 V. In the upper curve a minimum can be seen at about 4 ms, being marked by a dashed line. Said minimum corresponds to the abutment of the armature on the nozzle needle with subsequent opening of the needle and an injection process, as can be seen from the lower diagram of the injection profile. The curve corresponding to 7 V in the middle diagram has a minimum at about 5 ms. As the injection rate profile shows, no injection process occurs in this case, which means that the displacement of the armature is stopped by the abutment on the nozzle needle.

The minimum of the first derivative of the current for a voltage application of 7 V is associated with the armature contact and thereby with the commencement of the opening of the nozzle needle of the injector.

Figure 3:
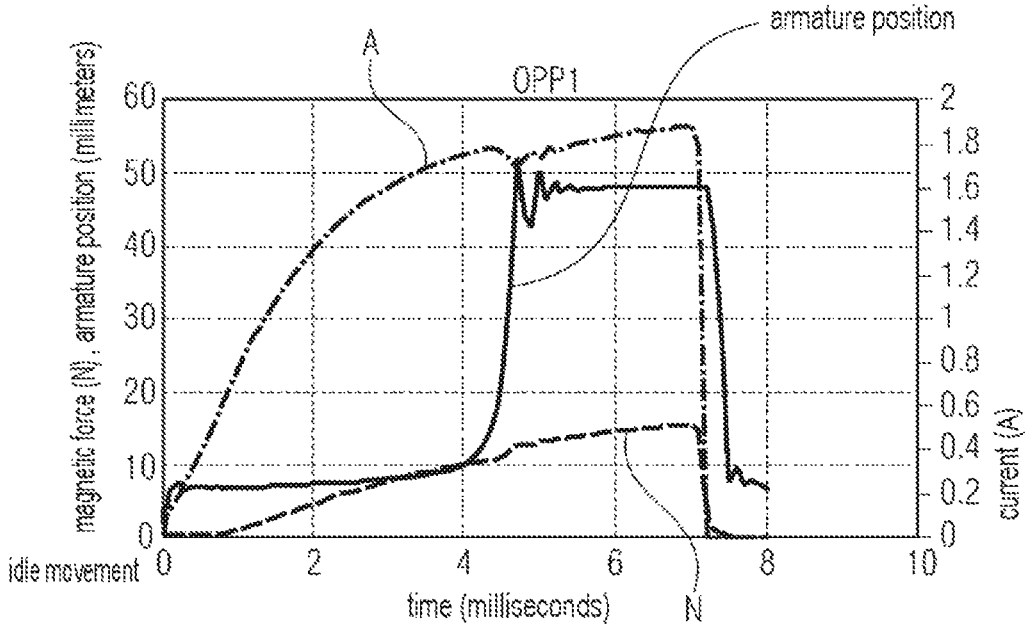
FIG. 3 includes a diagram that shows the simulation results in relation to the profile of the magnetic force, the armature position and the coil current.

The operability of the method according to the invention has been demonstrated by simulations, the results of which are shown in FIG. 3. The corresponding voltage, to which the coil is subjected so that the armature overcomes the idle movement but the displacement thereof is stopped with abutment on the nozzle needle, can be determined empirically depending on the conditions. Good results have been obtained with the value of 7 V specified here.

FIG. 3 shows the profile of the magnetic force (N), of the armature position (μm) and of the coil current (A). With the example shown here, an idle movement of 40 μm is overcome. A further displacement of the armature together with the needle does not then take place. The abutment of the armature on the needle (OPP1) can be seen in the current profile.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for detecting the commencement of the opening of the nozzle needle of an injector of an injection system, with which an armature is displaced by applying a voltage to a coil, the armature overcomes an idle movement and abuts the nozzle needle, comprising the steps of:

applying a voltage to the coil such that the armature is displaced with such a speed against the nozzle needle that the armature displacement is stopped by the abutment without opening the nozzle needle; and detecting the abutment of the armature on the nozzle needle in the current profile as the commencement of the opening of the nozzle needle, the applying and detecting being performed without the nozzle needle of the injector being opened.

2. The method as claimed in claim 1, wherein detecting the abutment of the armature on the nozzle needle comprises the steps of forming a first derivative of the current against time, and associating a minimum thereof with the abutment of the armature on the nozzle needle.

3. The method as claimed in claim 2, wherein applying a voltage comprises the step of applying a voltage of 7 V to the coil, the voltage of 7 V being less than a voltage applied to the coil for opening the needle nozzle.

4. The method as claimed in claim 1, wherein applying a voltage and detecting abutment of the armature on the nozzle needle are performed by a control unit of a motor vehicle.

5. A method for detecting the commencement of the opening of the nozzle needle of an injector of an injection system, the injector including an armature, a nozzle needle and a coil, the injector having idle movement between the armature and the nozzle needle, and the armature is movable by applying a voltage to the coil and abuts the nozzle needle in response to the applied voltage, the method comprising:

applying a voltage to the coil such that the armature moves, abuts against the nozzle needle, and is stopped by the abutment without opening the nozzle needle, the voltage applied being less than a voltage to open the nozzle needle; and detecting the abutment of the armature on the nozzle needle in the current profile as the commencement of the opening of the nozzle needle, the applying and detecting being performed without the nozzle needle of the injector being opened.

6. The method of claim 5, wherein detecting the abutment of the armature on the nozzle needle comprises forming a first derivative of the current against time, and associating a minimum of the first derivative of the current against time with the abutment of the armature on the nozzle needle.

7. The method as claimed in claim 5, wherein applying a voltage comprises applying a voltage of 7 V to the coil, the voltage of 7 V being less than a voltage applied to the coil for opening the needle nozzle.

8. The method as claimed in claim 5, wherein applying a voltage and detecting abutment of the armature on the nozzle needle are performed by a motor vehicle control unit.

* * * * *